United States Patent [19]

Desjardins

[11] Patent Number: 4,665,383

[45] Date of Patent: May 12, 1987

[54] SECURITY SYSTEM WITH MONITORING AND WARNING CIRCUITS

[75] Inventor: Paul A. Desjardins, Commack, N.Y.

[73] Assignee: Firecom, Inc., Woodside, N.Y.

[21] Appl. No.: 725,718

[22] Filed: Apr. 22, 1985

[51] Int. Cl.[4] ..... G08B 29/00

[52] U.S. Cl. ..... 340/506; 340/505; 340/508; 340/517; 340/518; 340/692; 340/384 E

[58] Field of Search ..... 340/506, 505, 500, 501, 340/508, 517, 518, 521, 384 E, 692; 324/51, 66, 57 R; 179/175.3 A, 175.3 F

[56] References Cited

U.S. PATENT DOCUMENTS

| | | | |
|---|---|---|---|
| 3,906,491 | 9/1975 | Gosswiller et al. | 340/384 E |
| 3,921,168 | 11/1975 | Dunbar | 340/505 |
| 4,064,507 | 12/1977 | Schmitz | 340/384 E |
| 4,067,008 | 1/1978 | Sprowls | 340/505 |
| 4,100,543 | 7/1978 | Stockdale et al. | 340/384 E |
| 4,141,006 | 2/1979 | Braxton | 340/505 |
| 4,206,450 | 6/1980 | Harden et al. | 340/384 E |
| 4,229,734 | 10/1980 | Schultz | 340/505 |
| 4,342,985 | 8/1982 | Desjardins | 340/525 |
| 4,361,832 | 11/1982 | Cole | 340/505 |

*Primary Examiner*—Donnie L. Crosland
*Attorney, Agent, or Firm*—Nolte, Nolte and Hunter

[57] ABSTRACT

A central protection system suitable for the protection of a building from fire and other hazards includes a set of environmental sensors and circuitry for interrogating the sensors. The system also includes communication and control lines, as well as monitoring circuitry having individual channels coupled to respective ones of the communication and control lines. An inaudible pilot tone of subsonic frequency may be coupled to a communication line, and the corresponding channel of the monitoring circuit includes a detector of the pilot tone. A circuit for the generation of evacuation signals and fire brigade signals is composed of two sections coupled in tandem, and includes sequencing circuitry for the recycling of tones produced by the respective sections.

10 Claims, 4 Drawing Figures

TONE SWITCHING UNIT, 26
SIG.OFF
SW.
70
RES
EVACUATION
SW.
71
TOGGLE
FF
75
79
EVAC
FF
74
77
78
SIGNAL ON
LAMP
ALARM
82
FF
73
RES
SW.
69
ACKNOWLEDGE
CHASER
84

90
PILOT TONE OSC.
97
98
92
94
ANALOG DATA
106
V1
102
108
104
100
110
112
116
114
118
120
V2
124
122
121
86
COMMUNICATION MONITOR, 30
126
132
V2
138
128
134
130
86
136
V1
178
184
V2
174
DIGITAL DATA
164
182
183
175
173
166
168
181
170
88
CONTROL POWER
V
146
152
148
144
142
150
140
88
CLOCK
V
159
156
TO MUX, 52
V
160
154
161
ADDR
ENCODER, 57

SECURITY SYSTEM WITH MONITORING AND WARNING CIRCUITS

BACKGROUND OF THE INVENTION

This invention relates to a central security system for a building and, more particularly, to circuitry for selecting audible warning signals and for monitoring such signals, as well as other command and communication signals employed in the security system.

There is presently a growing requirement for providing large buildings with systems which can detect emergency conditions. For example, in large apartment or office buildings, smoke detectors and the like may be located throughout the building with each detector being connected to a central monitoring console which is to be manned at all times. One such system is shown in the U.S. Pat. No. 4,342,985. The system employs circuitry for addressing detectors in various parts of the building (or other facility) which is to be protected. The addressing of remote areas is synchronized with the addressing of electrical equipment in a central station to permit the use of time-division multiplexing and the transmission of signals from the detectors located in various remote sites. The multiplexed signals are communicated by a single monitoring wire to a central console for illumination of status lamps on the console.

While the addressing of signals in the foregoing patent is illustrated with switch arrays and AND gates, for both monitoring and control functions, it is to be understood that such addressing and multiplexing can be accomplished with other forms of addressing units such as those employing counters and read-only memories which drive electronic selector switches or multiplexers. Also, while the encoding of data is illustrated therein by the changing of bits in a serial two-bit signal, it is to be understood that the system may employ a more complex form of digital encoding of the data provided by the various detectors and sensors. In addition, the distribution of clock signals from a central clock to the outlying areas could be replaced with a set of satellite clocks synchronized with a common synchronization signal.

A problem arises in that the foregoing detector and sensing circuits are restricted to a sensing of environmental conditions such as heat, smoke and door openings. However, there are other functions relating to the transmission of communications, such as the continuity of circuitry for announcements, telephone lines, digital control lines, and sound generation (whoops and chimes) circuits which should also be monitored. In addition, it is desirable that the sound generation circuitry, as well as the circuitry for monitoring communications, should have a format of construction which allows easy replacement and substitution into a variety of security systems.

SUMMARY OF THE INVENTION

The foregoing problem is overcome and other advantages are provided by monitoring and sound control circuitry which, in accordance with the invention, are adapted for inclusion in a variety of central protection systems, particularly fire alarm systems for protecting large buildings.

The communication monitoring circuitry is provided with a set of input channels, any of which can be switched out when not required. Some of the input channels are provided with an RC (resistor-capacitor) integrator for detection of the presence of command or data signals, as well as an inaudible pilot tone which may be injected into a voice communication link to ascertain operation of the voice link. Such integration is deleted in input channels having a DC (direct current) voltage such as a telephone line or power line. The input channels connect with an output relay circuit which signals an alarm by a switch closure when any of the input channels detects a fault.

Sound generation equipment, in accordance with the invention, incorporates both a whoop tone (pulsed siren form of sound) and a chime tone generator along with sequencing circuitry on a single IC (integrated circuit) card. By using two of the cards connected in tandem, with the first card producing a whoop tone and the second card producing a chime tone, the first card drives the second card for alternating whoop and chime tones as may be used for signaling evacuation of personnel and alerting of a fire brigade. A monitor circuit is included on each card for sensing the generation of the electric tone signals, prior to their being coupled to a sound device such as a horn.

In the general case, a central protection system includes: (1) a set of environmental sensors, such as detectors of heat and smoke, as well as sensors of dangerous air-borne chemicals such as methane or other heating fuels which might result in an explosion; (2) circuitry for interrogating the sensors to extract data therefrom; (3) apparatus such as lamps and horns for warning personnel of danger when detected by the sensors; and (4) automatic control circuits to provide functions such as the closing of fire doors in response to the danger detected by the sensors. Also included are amplifiers, telephones and other such communication equipment plus the interconnecting electric wiring whereby communication and control signals are transmitted throughout the building or other facility being protected.

The monitoring equipment of the invention presents further security by providing data as to the operability of the electric lines carrying the command and control signals, as well as the status of signals which are to be continuously present when the system is operating. The sound generation equipment of the invention permits the generation of sequential forms of warning and command tones by the use of a plurality of tone generators operated in tandem, thereby reducing the amount of the foregoing control lines which would otherwise be required.

BRIEF DESCRIPTION OF THE DRAWINGS

The foregoing aspects and other features of the invention are explained in the following description taken in connection with the accompanying drawings wherein.

DETAILED DESCRIPTION

Figure 1:
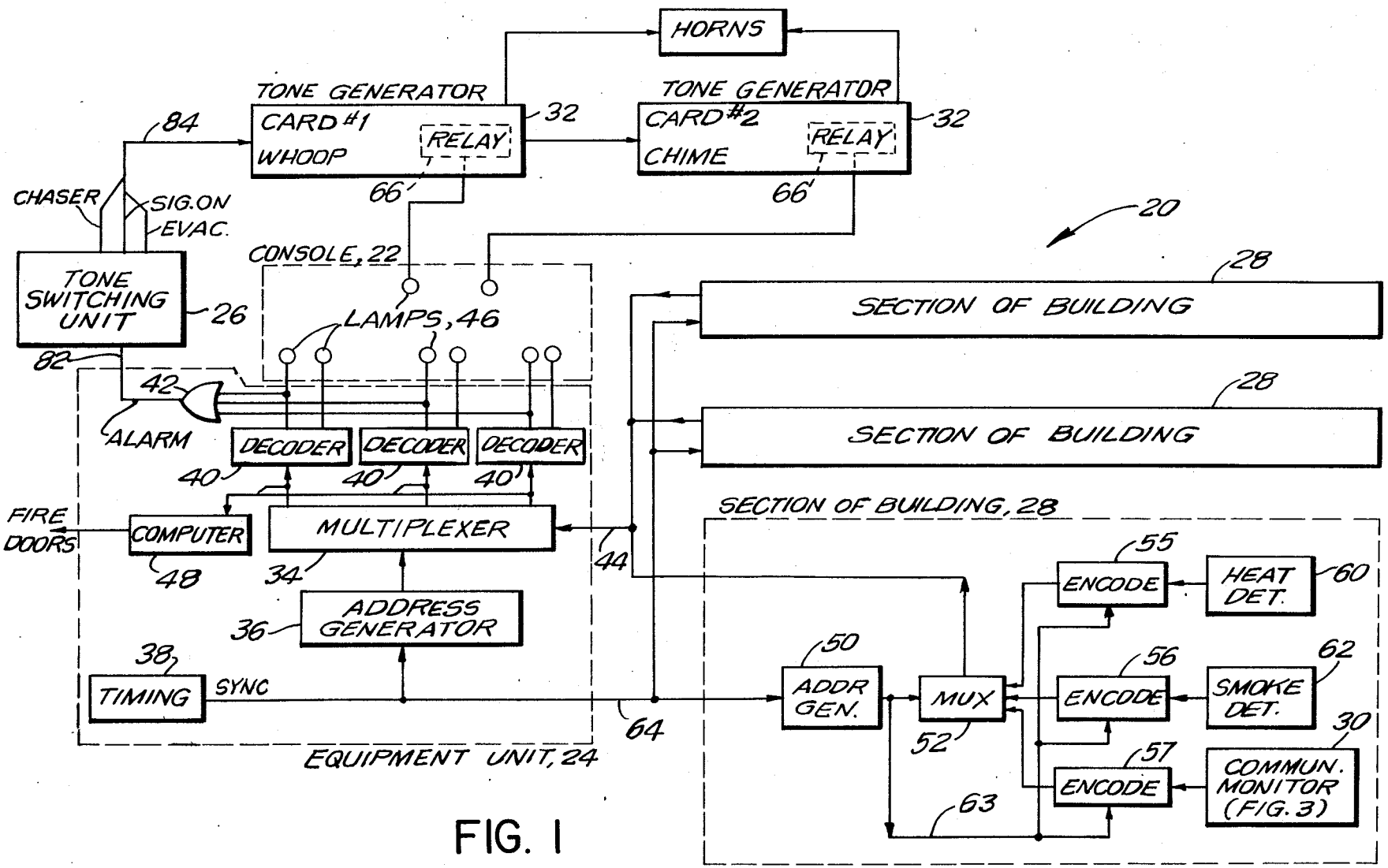
FIG. 1 shows a central fire control system having multiplexing equipment for communication of signals from remote locations to a central station, the system including communication monitoring equipment and sound control equipment in accordance with the invention.

With reference to FIG. 1, there is shown a central protection system for a large building or other facility, the system being presented as an exemplary fire control system 20. The system 20 includes a central station incorporating a console 22, an electrical equipment unit 24, and a tone switching unit 26. Well known telephone lines and other communication lines, including their respective amplifiers and other circuit elements, have been omitted to simplify the drawing. The building is divided into sections 28 (each of which may comprise a set of floors) each of which contains sensing equipment, and a communication monitor 30 in accordance with the invention. The system 20 also comprises a pair of tone generators 32 in accordance with the invention. One pair of generators 32 may be used for sounding horns throughout the building, or additional pairs of the generators 32 may be employed with additional switching units 26 (not shown) for servicing specific parts of the building.

The electrical equipment unit 24 comprises a multiplexer 34, an address generator 36, a timing unit 38, decoders 40 and an OR gate 42. Time-division multiplexed signals presenting the status of sensors, such as heat and smoke sensors, are coupled from all the building sections 28 via a monitoring line 44 to the multiplexer 34. The multiplexer 34 distributes the signals from line 44 among the decoders 40 which decode the signals to illuminate status lamps 26 on the console 22. Alarm signals detected by the decoders 40 are coupled via the OR gate 42 to the switching unit 46 for activating the generators 32. For example, a generator 32 may produce a whoop tone for commanding evacuation of the building, or a chime tone for alerting a fire brigade. The output terminals of the multiplexer 34 may also be coupled to a computer 48 which is programmed to generate signals for the closing of fire doors at locations corresponding to the sensors which have transmitted an alarm signal.

Each section 28 of the building contains exemplary multiplexing circuitry comprising an address generator 50, a multiplexer 52, three encoders 55–57, a heat detector 60, a smoke detector 62 and the aforementioned communication monitor 30. The generator 50 receives synchronization signals along line 64 from the timing unit 38 so as to operate in synchronism with the address generator 36. Thereby, the multiplexer 52 is addressed in synchronism with the addressing of the multiplexer 34, so as to sequentially couple signals of the encoders 55–57 in synchronism with the coupling of the signals to the respective decoders 40. The encoders 55–57 receive clock signals on line 63 for encoding the data provided by the detectors 60, 62 and the monitor 30. The encoders 55–57 may operate in the manner of the logic circuitry set forth in the foregoing patent to provide for two-bit words on the monitor line 44, these words appearing serially by time-division multiplexing imparted by the successive switching of the multiplexer 52. Alternatively, the encoders 55–57 can provide more complex forms of digital words for identifying the status of the various sensors such as the detectors 60 and 62 and the monitor 30.

In operation, the circuitry of the equipment unit 24 in cooperation with the multiplexing circuitry of a building section 28 serves to interrogate the sensors in that section of the building. As the addresses provided by the generators 36 and 50 reach the addresses of sensors located in a second section 28 of the building, the multiplexer of that section is operated to sequentially switch the status signals of the sensors therein to the monitor line 44. The signals transmitted from the outlying sections of the building to the central station are decoded by the decoders 40 to illuminate such ones of the lamps 46 as indicate an alarm, with the alarm signals also being coupled via the gate 42 and the switching unit 26 for operation of the tone generators 32. Each of the generators 32 includes a relay circuit 66 for illumination of further lamps 46 on the console 22 indicating the status of the tones. The switching unit 26, as will be described with reference to FIG. 2, permits an operator at the console 22 to select which of the tones is to be sounded by the horns.

Figures 2, 3:
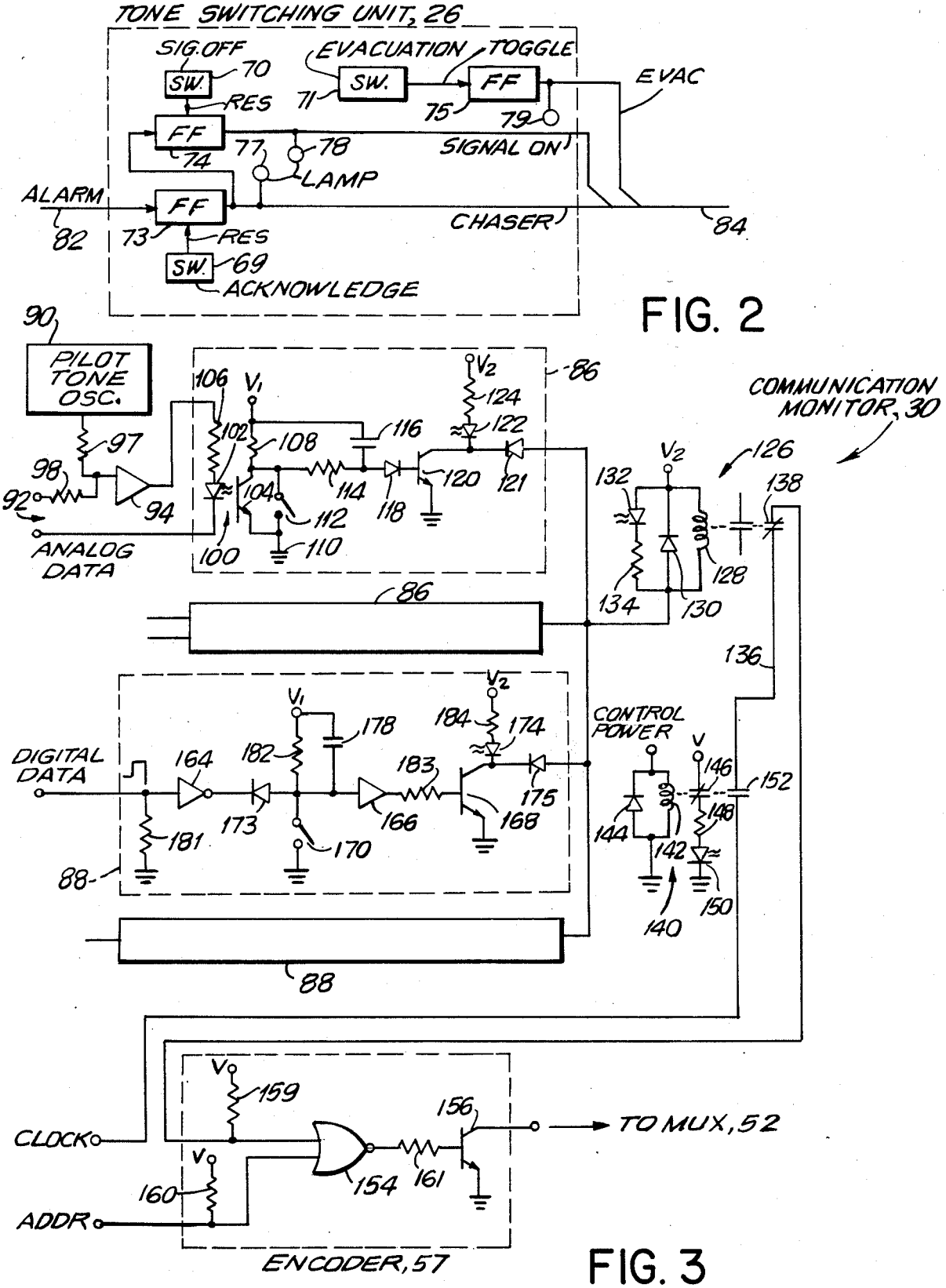
FIG. 2 shows a tone switching unit of FIG. 1 for selection of whoop and chime tones from the tone generators.
FIG. 3 shows circuitry of the communication monitoring equipment of FIG. 1.

With reference to FIG. 2, the switching unit 26 comprises three switches 69–71, three flip-flops 73–75 and three lamps 77–79. The input alarm signal on line 82 is coupled to the set terminals of the flip-flop 73. There are three output signals which are shown fanning into the output line 84 for transmission to the first tone generator 32. The switches 69 and 70 are coupled to the reset terminals of the flip-flops 73 and 74, respectively. The switch 71 is coupled to a toggle input of the flip-flop 75. The output signals of the flip-flops 73–75 are labeled as "chaser", "signal on" and "evacuation" for reasons that will become apparent in the ensuing description. The output terminals of the flip-flops 73–75 connect with the lamps 77–79 for indicating the presence of the foregoing signals.

In operation, upon the presence of an alarm on line 82, the flip-flops 73–74 activate the "chaser" and "signal on" signals. The operator is alerted by the lighting of the lamps 77–78, and acknowledges the presence of the "chaser" signal by pressing the switch 69 to reset the flip-flop 73. The "chaser" signal is used to activate the tone generators 32 to alert the fire brigade in the event that the operator is away from the console 22. Thus, upon operation of the switch 69, the light on the lamp 77 is extinguished and the "chaser" signal is no longer present to activate the tone generators 32 to call the fire brigade. The operator will call the fire brigade by telephone to provide the precise location of the fire, such communication being done over a telephone line which is monitored by the communication monitor 30 (FIG. 1). Later, the operator presses the switch 70 to reset the flip-flop 74, extinguish the light of the lamp 78 and turn off the "signal on", and thereby discontinue an evacuation signal produced by the tone generators 32. Even in the absence of an alarm signal on line 82, the operator can still direct the signaling of an evacuation signal from the horns (FIG. 1) by pressing the switch 71 to operate the flip-flop 75, the evacuation signal being indicated by a lighting of the lamp 79. A further pressing of the switch 71 resets the flip-flop 75 to turn off the evacuation signal.

FIG. 3 shows circuitry of the communication monitor 30 of FIG. 1. The monitor 30 has a set of input channels, the channels differing slightly in their circuitry to accommodate different measuring tasks. Two types of channels 86 and 88 are shown. The channel 86 is adapted for sensing a pilot tone within a telephone line, while the channel 88 is adapted for sensing the presence of digital signals in a communication circuit. The pilot tone, which may have a sinusoidal or square waveform, is provided by an exemplary oscillator 90, and is coupled into a telephone transmission line 92 by means of an amplifier 94 having input summing resistors 97–98 coupled respectively to the oscillator 90 and to the telephone line. Thereby, the telephone signal is complying with the pilot tone signal, the pilot tone signal being present even in the absence of the analog signal and data associated with the use of a telephone line.

The channel 86 comprises an optical isolator 100 formed of a light-emitting diode 102 and a photo transistor 104 positioned for receiving light emitted by the diode 102. An input resistor 106 couples the diode 102 to the output terminal of the amplifier 94. The collector terminal of the transistor 104 is coupled via a resistor 108 to a source of voltage V1. The emitter terminal of the transistor 104 is grounded at 110. The transistor 104 is operated as an electronic switch, the output thereof being shorted by a switch 112, connected between the collector terminal and ground, for switching out the channel 86 in the event that the channel 86 is not being used. A monitor 30 includes a plurality of the channels 86, as well as a plurality of the channels 88 to enable the monitoring of a plurality of telephone lines and digital data lines.

It is further noted that either of the channels 86 and 88 may be used for the detection of a DC voltage as is present on a telephone line or a power line, in which case the channel can be simplified by deletion of an RC integrator described hereinafter. Also, the pilot tone should have a subsonic frequency, on the order of 10–20 Hertz, so as to be inaudible to personnel using the communication line being sounded, i.e., provided with the pilot tone, by the pilot tone oscillator.

The channel 86 further comprises a resistor 114, a capacitor 116, a diode 118, a second transistor 120, diodes 121–122 and a resistor 124. A resistor 114 and the capacitor 116 are coupled in series across the resistor 108 to provide the function of an RC integrator of the output signal of the amplifier 104. The integrated output signal is coupled via the diode 118 to the base terminal of the transistor 120, the latter being operated as an electronic switch with its output signal at the collector terminal being coupled via the diode 121. The resistor 124 is coupled in series with the light-emitting diode 122 from a source of voltage V2 to the junction of the collector terminal of the transistor 120 and a terminal of the diode 121, the resistor 124 serving as a current limiting resistor in the electronic switch circuit of the transistor 120.

A relay circuit 126 is also connected from the voltage source V2 for the collector terminal of the transistor 120 to serve as a load therefor, the coupling being accomplished by the diode 121. The relay circuit 126 comprises a relay coil 128 serially connected between the diode 121 and the voltage source V2, a diode 130 in parallel with the relay coil 128, and the series combination of a light-emitting diode 132 and a resistor 134 which is connected in parallel to the coil 128. In operation, the successive pulses of the pilot tone signal produce pulses of current in the transistor 104, which pulses of current result in a charging of the capacitor 116. The resulting voltage across the capacitor 116 back-biases the diode 118 to shut off current flow in the transistor 120, this resulting in a de-energization of the relay coil 128. In the de-energized state, clock pulses can travel along the line 136 through the normally closed contact 138 of the relay circuit 126. In the absence of the pilot tone, which absence may be an indication of a shorting or opening in the telephone line, the relay coil 128 is energized to open the contact 138 to stop the flow of clock pulses in the line 136.

The monitor 30 further comprises a second relay circuit 140 for the monitoring of an electric power supply which energizes the control lines, such as the lines which direct the closing of fire doors. The circuit 140 includes a relay coil 142 which is connected across terminals of the power supply, there being a diode 144 connected in parallel with the coil 142. A normally closed contact 146 of the relay circuit 140 is connected in series with a resistor 148 and a light-emitting diode 150 for applying power from a separate source V for lighting the diode 150 in the event of a failure of the control power. A normally open contact 152 of the relay circuit 140 closes during the presence of the control power to allow the flow of clock pulses along the line 136. Thereby, the flow of clock pulses on the line 136 indicates the operation of the telephone line to which the channel 86 is connected, and also the presence of the control power.

FIG. 3 also shows a simplified circuit for the encoder 57 of FIG. 1. The encoder 57 comprises a NOR gate 154, a transistor 156 and three resistors 159–161. The two resistors 159–160 are connected to a source of voltage to serve as pull-up resistors for the input terminals of the NOR gate 154. The address line coupled to the resistor 160 is pulled down to a relatively low voltage (logic 0) by the address generator 50 to activate the encoder 57. Thereupon, clock pulses on line 136 are passed by the gate 154 and the resistor 161 to drive current pulses into the base terminal of the transistor 156. In response to the foregoing base drive, the transistor 156 applies current pulses, constituting the logic signal, to the multiplexer 52.

In the monitor 30, a channel 88 comprises an inverter 164, a buffer 166, a transistor 168, a switch 170, three diodes 173–175, a capacitor 178, and four resistors 181–184. In operation, the resistor 181 grounds an input terminal of the inverter 164, the input voltage rising above ground in the presence of a digital pulse signal. The resistor 182 and the capacitor 178 are connected in parallel, the parallel combination being connected serially by the switch 170 between a source of voltage V1 and ground. Digital pulses coupled by the inverter 164 are further coupled by the diode 173 to charge the capacitor 178 wherein the parallel combination of the resistor 182 and the capacitor 178 serve as an RC integrator. The output voltage of the integrator is applied by the buffer 166 and the resistor 183 to drive current through the base terminal of the transistor 168. In the event that the channel 88 is not in use, then the switch 170 is closed to ground the input terminal of the buffer 166. The transistor 168 is connected as an electronic switch, with the resistor 184 and the relay circuit 126 being connected to the collector terminal as a load, respectively by the light-emitting diode 174 and diode 175. Thereby, upon the activation of the transistor 168 with current pulses applied to the base terminal, the transistor 168 energizes the coil 128 to open the contact 138. It is noted that in the absence of the digital signal at the input terminal of the channel 88, the output terminal of the inverter 164 is at a relatively low (logic 0) voltage which results in an energization of the transistor 168 and the relay coil 128. In the presence of the digital data signal at the input terminal of the channel 88, the charging of the capacitor 178 produces the input voltage to the buffer 166 with a resulting de-energization of the transistor 168 and the relay coil 128. Accordingly, during the presence of the digital data signal, the relay contact 138 is closed to allow for the passage of clock pulses along the line 136. The presence of the clock pulses on line 136 operates the encoder 57 to produce a sequence of clock pulses during the interval of time during which the address signal to the encoder 57 is at logic 0, this sequence of clock pulses constituting the signal indicating that the lines monitored by the monitor 30 are operating properly. In the absence of the clock pulses, the encoder 57 outputs a steady logic 1 signal, this indicating a trouble due to the failure of one of the monitored lines. The light-emitting diodes 122 and 174 indicate which of the channels is sensing a line fault.

Figure 4:
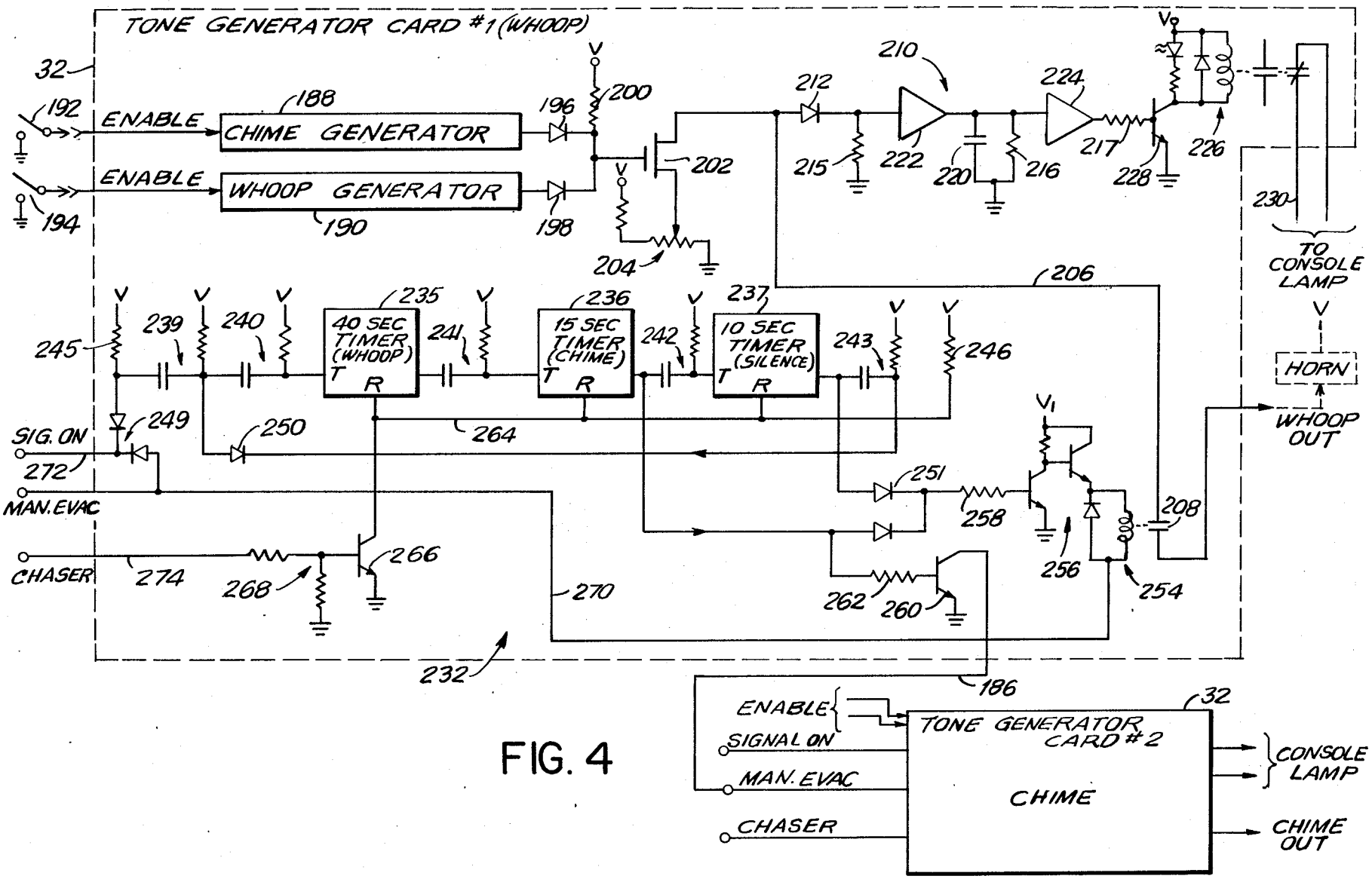
FIG. 4 shows tone control circuitry of the tone generator cards of FIG. 1.

FIG. 4 shows the construction of a tone generator 32, particularly the circuitry for the sequencing and monitoring functions. Each generator 32 is constructed conveniently as an integrated circuit on a card, FIG. 4 showing two such generators 32 connected via a line 186, which line carries a control signal for the cycling operation as will be explained in the ensuing description. The two tone generators 32 are of the same construction, each comprising a chime generator 188 and a whoop generator 190. Both the chime generator 188 and the whoop generator 190 may comprise well known circuitry which is commercially available. Each is activated by a logic 0 signal applied by switches 192 and 194 to the enable input terminals respectively of the chime generator 188 and the whoop generator 190. Output signals of the chime and whoop generators 188, 190 are coupled via a diode steering circuit comprising diodes 196, 198 and a resistor 200 to an analog electric switch 202, the switch 202 being a well known, commercially available component. The resistor 200 is connected to a source of voltage V for providing a positive bias to the gate terminal of the switch 202, the diodes 196 and 198 being coupled respectively from the generators 188 and 190 to the gate terminal of the switch 202. A second terminal of the switch 202 is connected to a potentiometer circuit 204 coupled between a source of voltage and ground while the third terminal of the switch 202 is coupled via line 206 though a relay contact 208 to provide the output electric tone signal of the generator 32. The output connection of the line 206 is to be made by the horn or other signaling device to a source of voltage V to complete the electric circuit through the switch 202. The pulsations of electric current on the line 206 have the same frequency and duty cycle of the signals produced by the chime and whoop generators 188, 190 so as to provide for the sounding of a chime or whoop signal from the horn. Adjustment of the setting of the potentiometer circuit 204 varies the magnitude of the current pulses along the line 206 for adjusting the intensity of the sound produced by the horn.

The tone generator 32 also includes a monitoring circuit 210 which is coupled to the line 206 for monitoring the presence of the electric tone signal thereon. The monitoring circuit 210 comprises a diode 212, three resistors 215–217, a capacitor 220, two amplifiers 222 and 224, and a relay circuit 226 which is of the same form as the previously described relay circuit 126 (FIG. 3). In operation, the resistor 215 grounds an input terminal of the amplifier 222. Pulses on the line 206 are coupled via the diode 212 to the amplifier 222 which, in response to these pulses, charges the capacitor 220. The parallel combination of the capacitor 220 and the resistor 216 serve as an RC integrator which integrates a succession of the pulses to provide a voltage which is applied to an input terminal of the amplifier 224. In response to the voltage of the RC integrator, the amplifier 224 applies current via the resistor 217 to the base of a transistor 228 which drives the relay circuit 226. A line 230 passes through a normally closed contact of the relay circuit 226 to energize a lamp (not shown) on the console 22 of FIG. 1. In the absence of pulses on the line 206, the capacitor 220 has a relatively low voltage which energizes the transistor 228 and the relay circuit 226. The resultant contact opening on line 230 thereby signals the absence of tone pulses on the line 206. When such pulses are present, the capacitor 220 charges with a resultant de-energization of the transistor 228 and the relay circuit 226 to close the contact on line 230, this releasing the trouble indication.

The lower portion of the circuitry of the generator 32 constitutes a cycling circuit 232 which enables the cyclic operation of the two tone generators 32 with the first generator 32 producing a whoop tone and the second generator 32 producing a chime tone. The cycling circuit 232 comprises three timers 235–237, five RC coupling circuits 239–243 for coupling strobe pulses to and from the timers 235–237, two pull-up resistors 245–246 and three diode-steering circuits 249–251.

In operation, each of the timers 235–237 is a variable timer, the timer 235 being variable from 0 to 40 seconds, the timer 236 being variable from 0 to 15 seconds, and the timer 237 being variable from 0 to 10 seconds. The timer 235 designates an interval of time during which whoop signals are to be sounded, the timer 236 designates an interval of time during which chime signals are to be sounded, and the time 237 designates an interval of silence. The relay circuit 254 having the contact 208 is energized by a transistor amplifier 256 having an input base drive resistor 258. The cycling signal on line 186 is provided via a transistor amplifier 260 having a base drive resistor 262. The chaser signal is coupled to the reset line 264 via a transistor 266 having base drive circuit 268.

Each of the input signals "signal on", "manual evacuation", and "chaser" are activated by the presence of a logic 0 signal on the respective ones of the input lines. With respect to the energization of the relay circuit 254, it is noted that such energization takes place upon the presence of a logic 0 at the output of the steering circuit 251 and a logic 0 on the "manual evacuation" line 270. Accordingly, in the absence of output signals from both of the timers 236 and 237, and upon the presence of a logic-0 signal on line 270, the relay circuit 254 is energized to close the contact 208 for coupling out the tone signal on line 206.

In the presence of the "signal on" signal on line 272, the steering circuit 249 couples the logic 0 signal to line 270 for energization of the relay circuit 254 at the outputing of the tone signal on line 206. The logic 0 on line 272 is also coupled via the circuit 239 and 240 to strobe the timer 235. It is noted that the timers 235–237 must first be reset by a logic 1 signal on line 264. Such resetting occurs upon application of a logic 0 signal, the "chaser" signal on line 274, terminates current flow in the transistor 266, allowing the resistor 246 to pull up the voltage on line 264 to a logic 1 level. This resets the timers 235–237.

As was explained previously with reference to FIG. 2, the triggering of the flip-flop 74 by the output signal of the flip-flop 73 results in the appearance of the "chaser" signal prior to the appearance of "signal on". Accordingly, with reference to FIG. 4, line 274 (chaser)

receives a logic-0 signal prior to line 272 (signal on). Accordingly, the termination of current to the transistor 266 in response to the logic 0 on line 274, and the consequent raising of the voltage on line 264 by the resistor 246 to a logic 1 occurs prior to the occurrence of the logic 0 signal on line 272. Thus, the timers 235–237 are reset by the logic 1 signal on line 264 prior to the occurrence of the logic 0 signal on line 272.

Thereby, the signal on line 272 provides two functions; namely, the triggering of the timer 235 by the steering circuit 249 and the energization of the relay circuit 254 by the steering circuit 249 and the line 270. The tone signal on line 206 is outputed until such time as the timer 235 completes its timing interval, at which point in time the timer 235 strobes the next timer 236 via the circuit 241. With the strobing of the timer 236, a logic 1 pulse appears at its output terminal, the pulse being coupled via the steering circuit 251 to de-energize the relay circuit 254 and to terminate the outputing of the tone signal on line 206. It is noted that the output signal of the timer 236 is also coupled via the resistor 262 and transistor 260 to the "manual evacuation" input terminal of the second tone generator 32 which, in view of the foregoing explanation, activates the second tone generator 32 to output a chime tone signal to the horn or other sounding device. Thereby, while the whoop tone of the first tone generator 32 has been discontinued by the timer 236, the outputing of the chime tone from the second tone generator 32 has been enabled by the timer 236.

At the conclusion of the timing interval of the timer 236, the output logic 1 pulse of the timer 236 is terminated with a resultant strobing of the timer 237 via the circuit 242. Since the output logic 1 pulse of the timer 236 is no longer being applied by the transistor 260 to the second tone generator 32, the chime tone is no longer outputed by the second tone generator 32. The strobing of the timer 237 introduces an output logic 1 signal from the timer 237 which is coupled via the steering circuit 251 to maintain the relay circuit 254 in a state of de-energization. Thus, outputing of the whoop tone on line 206 continues to be blocked by the open contact 208. Thus, there appears an interval of silence based on the amount of time selected in the timer 237.

Upon termination of the output logic 1 pulse of the timer 237, this occurring at the conclusion of the timing interval of the timer 237, a negative pulse is coupled via the circuit 243 back through the diode 250 at the circuit 240 to re-trigger the timer 235. In view of the capacitive coupling of the circuits 239 and 240, such re-triggering occurs independently of the logic 0 signal on line 272, which signal is blocked by the capacitors of the circuits 239 and 240. Thereby, the recycling of the chain of events through the three timers 235–237 can proceed. This recycling continues as long as the logic 0 signal is present on line 270, which presence is assured by the logic 0 signal on line 272 coupled via the steering circuits 249. Upon release of the chaser signal on line 274, the signal on line 264 goes low to a logic 0, this disabling the timers 235 and 237 with the result that the second tone generator 32 no longer becomes enabled. Accordingly, with the release of the chaser signal via the switch 69 in FIG. 2, the whoop signal is continuously outputed from the first tone generator 32 while no chime signal is outputed by the second tone generator 32.

Upon termination of the logic 0 signal on line 272 by the switch 70 of FIG. 2, the relay circuit 254 is de-energized with a consequent termination in the outputing of the whoop signal from the first tone generator 32. Thereby, use of the switches 69 and 70 of FIG. 2 enable the alternation of whoop and chime tone signals outputed in cyclical fashion by the pair of tone generators 32.

The foregoing description has provided the details of the construction of a central protection system for a building or other facility employing remote sensors for sensing environmental conditions, the system also including a monitoring of the command and control lines of the system for more reliable operation. In addition, a pair of tone generators having monitoring circuits therein permit the cycling of different tones by internal sequencing circuits, which circuits do not require timing signals from the central station of the protection system. In addition, the monitoring of the tone signals provides for more reliable operation of the tone generation.

It is to be understood that the above-described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. In a central protection system suitable for protecting a building, the system having a set of environmental sensors and a set of communication and control lines for transmitting electric signals in response to data received from said sensors, the improvement comprising:

means for monitoring the operability of said lines;

means for interrogating said sensors and said monitoring means to extract data therefrom; and means responsive to said data for transmitting communication and/or control signals over said lines for the protection of property and/or personnel.

2. A system according to claim 1, further comprising:

tone generation means;

switching means coupling said tone generation means to said interrogating means for selecting a mode of operation responsive to signals of said interrogating means; and wherein said tone generating means generates cyclically a plurality of different forms of tones, said tone generation means including a first unit and a second unit of like construction having sequencing circuitry, the sequencing circuitry of the first of said units being coupled in tandem with the sequencing circuitry of the second of said units to provide for the cycling of a tone of said first unit with a tone of said second unit in response to a signal of said interrogating means coupled solely to said first unit.

3. A system according to claim 2, wherein each of said units of said tone generation means includes means for sensing the presence of a tone, and wherein each of said sensing means is coupled to said interrogating means for transmitting thereto to the status of each of the respective tones.

4. A system according to claim 3, wherein said monitoring means includes a set of channels coupled to respective ones of said lines, one of said channels comprising an integrator for detection of signal pulses on one of said lines.

5. A system according to claim 4, wherein said monitoring means further comprises a pilot tone generator for providing said signal pulses to be detected on said one of said lines coupled to said one channel.

6. A system according to claim 5, wherein:

the sequencing circuitry of each unit of said tone generation means comprises a set of serially connected timers, steering circuitry connected to output terminals of a plurality of said timers, and means coupled to said steering circuitry for switching a tone on and off;

the operations of respective ones of said timers are staggered such that one timer strobes the next timer; and the switching means of said second unit is coupled to the steering circuitry of said first unit to provide for recycling of a tone of said first unit with a tone of said second unit in response to the staggered operation of the timers in said first unit.

7. A system according to claim 2, wherein:

the sequencing circuitry of each unit of said tone generation means comprises a set of serially connected timers, steering circuitry connected to output terminals of a plurality of said timers, and means coupled to said steering circuitry for switching a tone on and off;

the operations of respective ones of said timers are staggered such that one timer strobes the next timer; and the switching means of said second unit is coupled to the steering circuitry of said first unit to provide for recycling of a tone of said first unit with a tone of said second unit in response to the staggered operation of the timers in said first unit.

8. A system according to claim 1, wherein said monitoring means includes a set of channels coupled to respective ones of said lines, one of said channels comprising an integrator for detection of signal pulses on one of said lines, and wherein said monitoring means further comprises a pilot tone generator for providing said signal pulses to be detected on said one line.

9. In a central protection system suitable for protecting a building, the system having a set of environmental sensors and a set of communication and control lines for transmitting electric signals in response to data received from said sensors, the improvement comprising:

means for interrogating said sensors to extract data therefrom;

means responsive to said data for transmitting communication and/or control signals over said lines for the protection of property and/or personnel;

tone generation means;

switching means coupling said tone generation means to said interrogating means for selecting a mode of operation responsive to signals of said interrogating means; and wherein said tone generation means generates cyclically a plurality of different forms of tones, said tone generation means including a first unit and a second unit of the same construction having sequencing circuitry, the sequencing circuitry of the first of said units being coupled in tandem with the sequencing circuitry of the second of said units to provide for the cycling of a tone of said first unit with a tone of said second unit in response to a signal of said interrogating means coupled solely to said first unit, each said unit including means for sensing the presence of a tone, said sensing means being coupled to said interrogating means tor transmitting thereto the status of each of the respective tones.

10. A system according to claim 9, wherein:

the sequencing circuitry of each of said units comprises a set of serially connected timers, steering circuitry connected to output terminals of a plurality of said timers, and means coupled to said steering circuitry for switching a tone on and off;

the operations of respective ones of said timers are staggered such that one timer strobes the next timer; and the switching means of said second unit is coupled to the steering circuitry of said first unit to provide for recycling of a tone of said first unit with a tone of said second unit in response to the staggered operation of the timers in said first unit.

* * * * *